US006763681B1

(12) United States Patent
Klundt

(10) Patent No.: US 6,763,681 B1
(45) Date of Patent: Jul. 20, 2004

(54) COMBINATION RING AND OBJECT HOLDER WITH INTEGRAL SPRING

(75) Inventor: Kalvin Klundt, Lagrange, KY (US)

(73) Assignee: K & A Design, LLC, Louisville, KY (US)

( * ) Notice: Subject to any disclaimer, the term of this patent is extended or adjusted under 35 U.S.C. 154(b) by 0 days.

(21) Appl. No.: 10/074,155

(22) Filed: Feb. 12, 2002

Related U.S. Application Data

(60) Provisional application No. 60/343,044, filed on Dec. 21, 2001.

(51) Int. Cl.[7] ..... A63H 33/00; A44C 13/00; A44C 5/00

(52) U.S. Cl. ..... 63/1.11; 63/1.16; 63/15; 63/30; 63/3; 446/71; 446/73; 446/76; 446/75; 446/26; 446/236; 446/486

(58) Field of Search ..... 63/1.11, 1.16, 63/15, 30, 3; 446/71, 73, 75, 76, 26, 236, 486

(56) References Cited

U.S. PATENT DOCUMENTS

| | | | | | |
|---|---|---|---|---|---|
| 1,179,025 | A | * | 4/1916 | Molinaro | 116/75 |
| 2,074,643 | A | * | 3/1937 | Domenego | 24/3.2 |
| D205,899 | S | * | 10/1966 | Zimmerman | D21/454 |
| 3,643,467 | A | * | 2/1972 | Postel | 63/29.1 |
| D242,646 | S | * | 12/1976 | Shorin et al. | D11/2 |
| 4,413,443 | A | * | 11/1983 | Kulesza et al. | 446/26 |
| 5,115,648 | A | * | 5/1992 | Salvucci | 63/15 |
| 6,077,144 | A | * | 6/2000 | Fishman | 446/236 |

* cited by examiner

*Primary Examiner*—Robert J. Sandy
*Assistant Examiner*—Katherine W Mitchell
(74) *Attorney, Agent, or Firm*—Stites & Harbison, PLLC; David W. Nagle, Jr.

(57) ABSTRACT

A combination ring and object holder with an integral spring is designed to secure and retain an object, such as a lollipop. The combination ring and object holder includes a ring, preferably fabricated from plastic, with a substantially flat upper surface to which a spring is secured, and further includes a coupling member secured to the opposite end of the spring which preferably defines a central opening in the upper surface thereof for receiving and retaining an object.

15 Claims, 2 Drawing Sheets

COMBINATION RING AND OBJECT HOLDER WITH INTEGRAL SPRING

CROSS-REFERENCE TO RELATED APPLICATIONS

The present application claims priority from U.S. Provisional Application Serial No. 60/343,044 filed Dec. 21, 2001, the entire disclosure of which is incorporated herein by reference.

BACKGROUND OF THE INVENTION

The present invention is a combination ring and object holder with an integral spring. In the preferred embodiments disclosed herein, the object holder is designed to secure and retain candy, such as a lollipop. Furthermore, in the preferred embodiments disclosed herein, the spring is a helical spring commonly referred to as a Slinky® (a registered trademark of Poof Products, Inc. of Plymouth, Mich.).

The Slinky® toy was invented in 1945 by Richard James, a naval engineer who was experimenting with tension springs. Since its introduction into the marketplace. various manufacturers have developed toy products and novelties incorporating a spring, such as a Slinky®. Nevertheless, Applicant is aware of no efforts to include such a spring in a object holder as described herein or to attach such a spring to a ring.

It is a paramount object of the present invention to provide a combination ring and object holder with an integral spring, resulting in a novelty item that has great consumer appeal, especially to children.

This and other objects and advantages of the present invention will become apparent upon a reading of the following description.

SUMMARY OF THE INVENTION

The present invention is a combination ring and object holder with an integral spring that is designed to secure and retain an object, such as a lollipop. Specifically, the combination ring and object holder includes a ring, preferably fabricated from plastic, with a substantially flat upper surface to which a spring is secured. The combination ring and object holder further includes a coupling member secured to the opposite end of the spring which defines a central opening in the upper surface thereof for receiving and retaining an object.

DETAILED DESCRIPTION OF THE INVENTION

Figure 1:
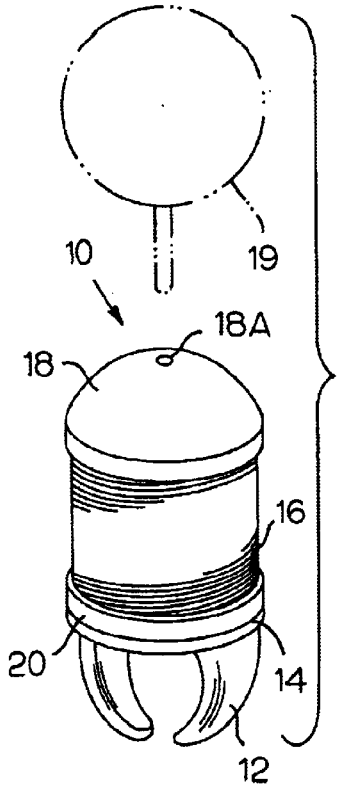
FIG. 1 is a perspective view of a preferred embodiment of a combination ring and object holder in accordance with the present invention, the integral spring being in a compressed state.
Figure 3:
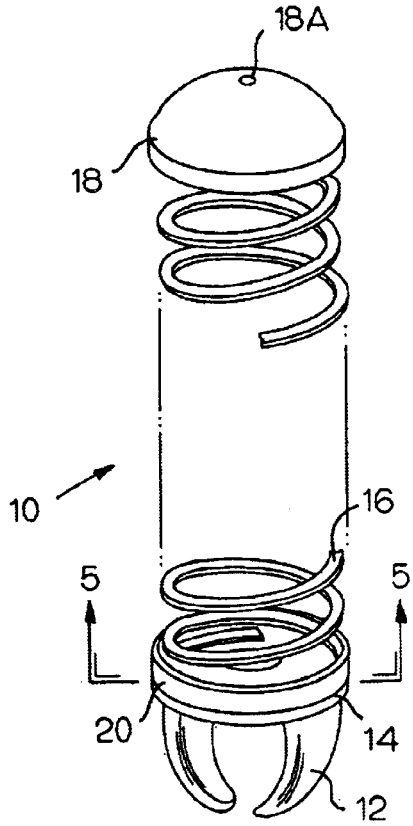
FIG. 3 is a perspective view of the combination ring and object holder of FIG. 1, the integral spring being in an extended state.
Figure 4:
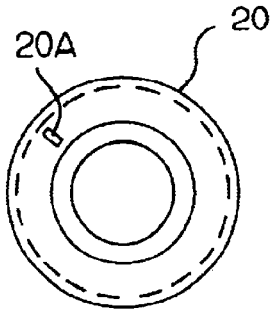
FIG. 4 is an end view of the spring base plate of the combination ring and object holder taken along line 4—4 of FIG. 2.
Figure 2:
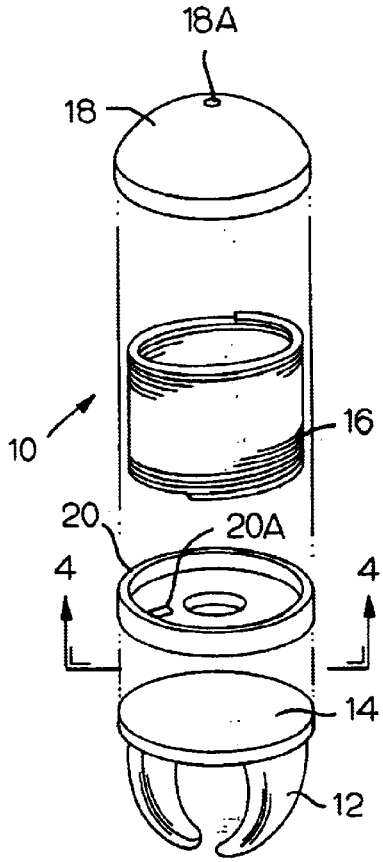
FIG. 2 is an exploded perspective view of the combination ring and object holder of FIG. 1.

The present invention is a combination ring and object holder with an integral spring. FIGS. 1–3 provide various perspective views of a preferred embodiment of a combination ring and object holder (generally indicated by reference numeral 10) made in accordance with the present invention. The combination ring and object holder 10 includes a ring 12, preferably fabricated from plastic, with a substantially flat upper surface 14 to which an integral spring 16 is secured. The ring 12 itself is not limited to being substantially circular and could include two separate prongs (as shown in the Figures) or be formed in a continuous closed loop. In addition, although not shown in the Figures of the present application, the upper surface 14 of the ring 12 need not necessarily be flat, but could also be conical, pyramidal or another shape, provided that attachment of the integral spring 16 is still possible.

In the preferred embodiments disclosed herein, the spring 16 is a plastic helical spring commonly referred to as a Slinky® (a registered trademark of Poof Products, Inc. of Plymouth, Mich.). Of course, a metal helical spring could also be incorporated into the combination ring and object holder 10 without departing from the spirit and scope of the present invention. Furthermore, the spring 16 may have various cross-sectional geometries, such as a rectangle or square, without departing from the spirit and scope of the present invention.

The combination ring and object holder 10 further includes a coupling member 18 secured to the opposite end of the spring 16. This coupling member 18 defines a central opening 18A in the upper surface thereof for receiving and retaining an object, such as a lollipop stick, indicated in phantom in FIG. 1 and generally indicated by reference numeral 19.

Figure 5:
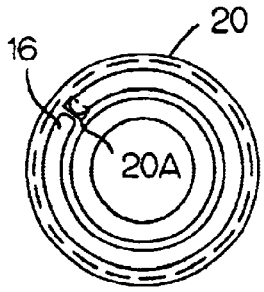
FIG. 5 is a sectional view of the combination ring and object holder taken along line 5—5 of FIG. 3.

Referring now to FIGS. 2–5, in one preferred embodiment of the present invention, the spring 16 is secured to the upper surface 14 of the ring 12 by a spring base plate 20. This spring base plate 20 defines an opening 20A adapted to received-the lower distal end of the spring 16. Specifically, the lower distal end of the spring 16 is threaded through the opening 20A such that approximately one complete coil of the spring 16 lies beneath the spring base plate 20, as shown in FIG. 5. Then, the spring base plate 20 is adhered (e.g., by glue) or otherwise attached to the upper surface 14 of the ring 12, thereby tightly securing the end of the spring 16 between the upper surface 14 of-the ring 12 and the spring base plate 20.

Finally, referring again to FIGS. 1–3, the coupling member 18 is secured to the upper distal end of the spring 16 by an adhesive (e.g., glue). Although not shown in the Figures, the coupling member 18 may also be secured to the spring 16 through various other techniques, including the threading technique described above with reference to the spring base plate 20 and FIGS. 4–5. In other words, the upper distal end of the spring 16 could threaded into a channel defined by the coupling member 18 such that approximately one coil of the spring 16 would be enclosed within the channel.

As a further refinement, it is also contemplated that the coupling member 18 itself could define an internal cavity for carrying objects, such as candy or gum pellets. Lastly, in the preferred embodiments described herein and depicted in the Figures, the coupling member 18 has a substantially smooth, rounded upper surface. Although not shown in the Figures, in another contemplated embodiment, the upper surface of the coupling member 18 would have a multi-faceted "jeweled" surface to increase its attractiveness and commercial appeal.

Figure 6:
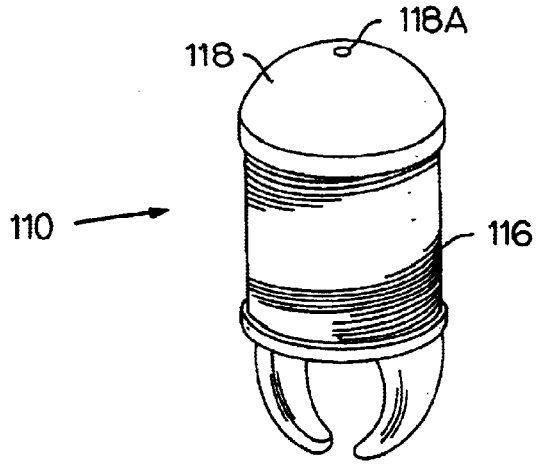
FIG. 6 is a perspective view of an alternate preferred embodiment of a combination ring and object holder in accordance with the present invention, the integral spring being in a compressed state.
Figure 7:
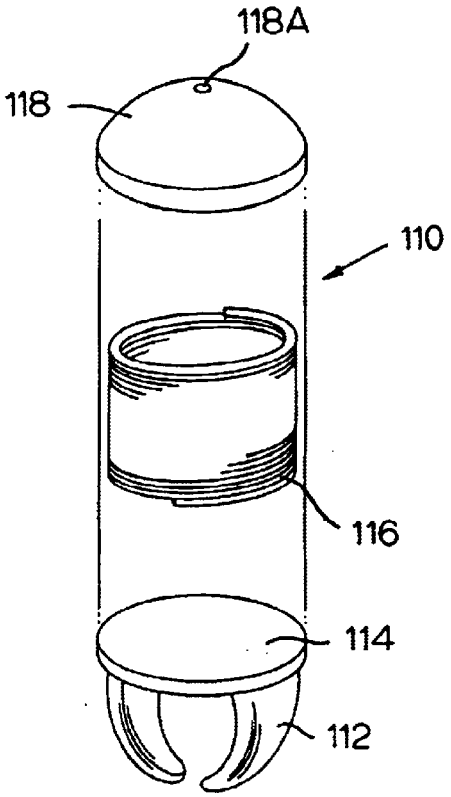
FIG. 7 is an exploded perspective view of the combination ring and object holder of FIG. 6.
Figure 8:
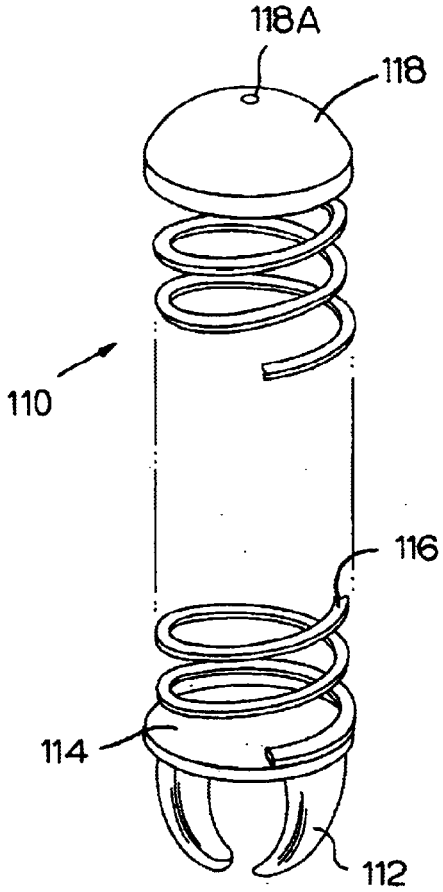
FIG. 8 is a perspective view of the combination ring and object holder of FIG. 6, the integral spring being in an extended state.

FIGS. 6–8 provide various perspective views of an alternate preferred embodiment of a combination ring and object holder (generally indicated by reference numeral 110) made in accordance with the present invention. As shown in FIGS. 6–8, in this alternate embodiment, the lower distal end of the spring 116 is secured directly to the upper surface 114 of the ring 112 by an adhesive.(e.g., glue), string or a similar attachment means. Similarly, the upper distal end of the spring 16 is secured to the coupling member 118 by an adhesive (e.g., glue), string or a similar attachment means. As with the embodiment described above with reference to FIGS. 1–5, the coupling member 118 in this alternate preferred embodiment defines a central opening 118A in the upper surface thereof for receiving and retaining an object, such as a lollipop stick. Also, as with the embodiment described above, it is also contemplated that the coupling member 118 itself could define an internal cavity for carrying objects, such as candy or gum pellets.

It will be obvious to those skilled in the art that other modifications may be made to the invention as described herein without departing from the spirit and scope of the present invention.

What is claimed is:

1. A combination ring and object holder comprising:

a ring adapted to be worn by an individual and defining a central axis;

a spring having a lower distal end that is secured directly to said ring, said spring defining a central axis that is oriented substantially perpendicular to the central axis defined by said ring so that the spring can move freely relative to said ring; and a coupling member adapted to receive and retain an object and secured to an upper distal end of said spring.

2. The combination ring and object holder as recited in claim 1, wherein said coupling member defines an opening to receive and retain an article of candy.

3. The combination ring and object holder as recited in claim 1, and further comprising a lollipop having a stick, the stick of said lollipop being received and retained in an opening defined by said coupling member.

4. The combination ring and object holder as recited in claim 1, wherein said coupling member has a smooth upper surface.

5. The combination ring and object holder as recited in claim 1, wherein the upper distal end of said spring is threaded through a channel defined by said coupling member such that approximately one coil of the upper distal end of said spring is enclosed within said channel.

6. The combination ring and object holder as recited in claim 1, wherein said ring has a substantially flat upper surface, the lower distal end of said spring being secured to the substantially flat upper surface of said ring.

7. The combination ring and object holder as recited in claim 6, wherein said ring also has a substantially circular lower portion oriented substantially perpendicular to said upper surface and adapted to be worn by an individual.

8. The combination ring and object holder as recited in claim 7, wherein the substantially circular portion of said ring is comprised of two independent prongs.

9. The combination ring and object holder as recited in claim 1, wherein said ring is composed of plastic.

10. The combination ring and object holder as recited in claim 1, and further comprising a spring base plate interposed between the lower distal end of said spring and a substantially flat upper surface of said ring.

11. The combination ring and object holder as recited in claim 10, wherein the lower distal end of said spring is threaded through an opening defined by said spring base plate such that approximately one coil of the lower distal end of said spring is secured between said spring base plate and the substantially flat upper surface of said ring.

12. The combination ring and object holder as recited in claim 1, wherein said spring is a plastic helical spring.

13. A combination ring and object holder comprising:

a ring having a substantially flat upper surface and a circular lower portion oriented substantially perpendicular to said upper surface and adapted to be worn by an individual;

a spring secured at a lower distal end thereof to the substantially flat upper surface of said ring, said spring being oriented in a substantially perpendicular relationship to the substantially flat upper surface so that the spring can move freely relative to said ring; and a coupling member adapted to receive and retain an object and secured to an upper distal end of said spring; and a lollipop having a stick, the stick of said lollipop being received and retained in an opening defined by said coupling member.

14. A combination ring and object holder comprising:

a ring adapted to be worn by an individual and defining a central axis;

a spring base plate secured to a substantially flat upper surface of said ring;

a spring secured at a lower distal end thereof directly to said spring base plate, said spring defining a central axis that is substantially perpendicular to the central axis defined by said ring so that the spring can move freely relative to said spring base plate and said ring; and a coupling member adapted to receive and retain an object and secured to an upper distal end of said spring;

wherein the lower distal end of said spring is threaded through an opening defined by said spring base plate such that approximately one coil of said spring is secured between said spring base plate and the substantially flat upper surface of said ring.

15. A combination ring and object holder comprising:

a ring adapted to be worn by an individual and defining a central axis;

a spring plate secured to a substantially flat upper surface of said ring;

a spring secured at a lower distal end thereof directly to said spring base plate, said spring defining a central axis that is substantially perpendicular to the central axis defined by said ring so that the spring can move freely relative to said spring base plate and said ring; and a coupling member adapted to receive and retain an object and secured to an upper distal end of said spring; and a lollipop having a stick, the stick of said lollipop being received and retained in an opening defined by a said coupling member.

* * * * *

UNITED STATES PATENT AND TRADEMARK OFFICE

CERTIFICATE OF CORRECTION

PATENT NO. : 6,763,681 B1
DATED : July 20, 2004
INVENTOR(S) : Kalvin Klundt

It is certified that error appears in the above-identified patent and that said Letters Patent is hereby corrected as shown below:

Column 4,
Line 51, add the word -- base -- between “spring” and “plate”.

Signed and Sealed this

Twenty-first Day of December, 2004

JON W. DUDAS
*Director of the United States Patent and Trademark Office*